US005577276A

United States Patent [19]

Nicholson et al.

[11] Patent Number: 5,577,276

[45] Date of Patent: Nov. 26, 1996

[54] CRIB BUMPER PAD WITH RELEASABLE SHEET

[76] Inventors: Beverley A. Nicholson; Kevin J. Nicholson, both of 8 Goldpine Ave., Courtice, Ontario, Canada, L1E1N7

[21] Appl. No.: 598,124

[22] Filed: Feb. 7, 1996

[51] Int. Cl.[6] ..... A47D 15/00; A47G 9/04

[52] U.S. Cl. ..... 5/424; 5/922; 5/496

[58] Field of Search ..... 5/424, 93.1, 425, 5/663, 922, 482, 495, 496, 498

[56] References Cited

U.S. PATENT DOCUMENTS 3,321,779 5/1967 Kaufman et al. ..... 5/93.1

4,670,923 6/1987 Gabriel et al. ..... 5/424

4,890,346 1/1990 Rist ..... 5/427

5,153,954 10/1992 Ohman ..... 5/93.1

5,163,191 4/1992 Chan ..... 5/99.1

*Primary Examiner*—Alexander Grosz

[57] ABSTRACT

The present invention relates to a bedding system for use in the interior of an infants crib. This invention enables the bedding to be changed quickly and easily. In its broadest context, the system employs a bumper pad which is adapted to be secured within the crib structure and a sheet which is adapted to be secured to the bumper pad. Thus, in use, the bumper pad can remain fixed to the crib structure and the sheet removed and replaced when new bedding is desired.

4 Claims, 3 Drawing Sheets

CRIB BUMPER PAD WITH RELEASABLE SHEET

BACKGROUND OF THE INVENTION

1. Field of the Invention

The present invention relates to bedding system and more particularly pertains to such a system which enables the easy removal of the mattress sheet.

2. Description of the Prior Art

The use of bumper liners is known in the prior art. More specifically, bumper liners heretofore devised and utilized for the purpose of lining a crib are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,010,611 to Mallett; U.S. Pat. No. 3,241,158 to Bearl; U.S. Pat. No. 3,619,824 to Doyle; U.S. Pat. No. 3,018,492 to Rosen; U.S. Pat. No. 4,670,923 to Gabriel each discloses bumpers or liners. Furthermore, U.S. Pat. No. 4,754,509 to Pollard discoses a retainer sheet.

In this respect, the bedding system according to the present invention substantially departs from the conventional concepts and designs of the prior art, and in doing so provides an apparatus primarily developed for the purpose of enabling the easy replacement of as infants bedding.

Therefore, it can be appreciated that there exists a continuing need for new and improved bedding system which can be used for lining an infant's crib. In this regard, the present invention substantially fulfills this need.

SUMMARY OF THE INVENTION

In view of the foregoing disadvantages inherent in the known types of bumper liners now present in the prior art, the present invention provides an improved bedding system. As such, the general purpose of the present invention, which will be described subsequently in greater detail, is to provide a new and improved bedding system and method which has all the advantages of the prior art and none of the disadvantages.

To attain this, the present invention essentially comprises a bedding system for use with a infant's crib. The system includes a bumper pad which is box shaped in the preferred embodiment. Furthermore, the bumper pad is defined by first, second, third, and fourth sidewalls, a bottom surface and an exterior and interior surface. Additionally, each of the sidewalls has an upper edge and a lower edge. Hook and pile fasteners, can be employed in securing the bumper pad to the sheet. A plurality of "rough side" hook and pile fasteners are secured to the interior surface of the bumper pad approximate the upper edge of the sidewalls.The bumper pad further includes first, second, third and fourth flaps with the first flap is secured to the upper edge of the first sidewall, the second flap is secured to the upper edge of the second sidewall, the third flap is secured to the upper edge of the third sidewall, and the fourth flap is secured to the upper edge of the fourth sidewall. Each of these flaps has a first orientation wherein the flap is positioned over the interior surface of its corresponding side wall, and a second orientation wherein the flap is positioned over the exterior surface of its corresponding side wall. In the preferred embodiment, the bumper pad includes a plurality of tie fasteners positioned upon the exterior surface of the sidewalls intermediate the upper and lower edges. These tie fasteners are tied to the interior of an infants crib when the bumper pad is to be secured. As with the bumper pad, the sheet is box shaped. Furthermore, the mattress pad is defined by a first, second, third and a fourth side wall, a bottom surface, an exterior surface and an interior surface. Additionally, each of these side walls has an upper edge and a lower edge. A plurality of "smooth side" hook and pile fasteners are secured to the exterior surface of the sheet approximate the upper edge of the sidewalls. The sheet is specifically dimensioned to be received within the bumper pad. When joining the sheet to the bumper pad, the sheet is positioned such that the exterior surface of the sheet meets the interior surface of the bumper pad. Furthermore, the rough side hook and pile fasteners of the bumper pad are placed into positive engagement with the smooth side hook and pile fasteners of the mattress pad. Then, in order to ensure that the mattress pad is positively secured, each of the flaps of the bumper pad is positioned in the first orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved bedding system which have all the advantages of the prior art bumper liners and none of the disadvantages.

It is another object of the present invention to provide new and improved bedding system which may be easily and efficiently manufactured and marketed.

It is further object of the present invention to provide new and improved bedding system which are of durable and reliable constructions.

An even further object of the present invention is to provide new and improved bedding system which are susceptible of a low cost of manufacture with regard to both materials and labor, and which accordingly are then susceptible of low prices of sale to the consuming public, thereby making such bedding system economically available to the buying public.

Still yet another object of the present invention is to provide new and improved bedding system which provide in the apparatuses and methods of the prior art some of the advantages thereof, while simultaneously overcoming some of the disadvantages normally associated therewith.

Even still another object of the present invention is to enable the easy replacement of a infant's bedding.

Lastly, it is an object of the present invention to provide new and improved bedding system for use in the interior of an infants crib. This invention enables the bedding to be changed quickly and easily. In its broadest context, the system employs a bumper pad which is adapted to be secured within the crib structure and a sheet which is adapted to be secured to the bumper pad. Thus, in use, the bumper pad can remain fixed to the crib structure and the sheet removed and replaced when new bedding is desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
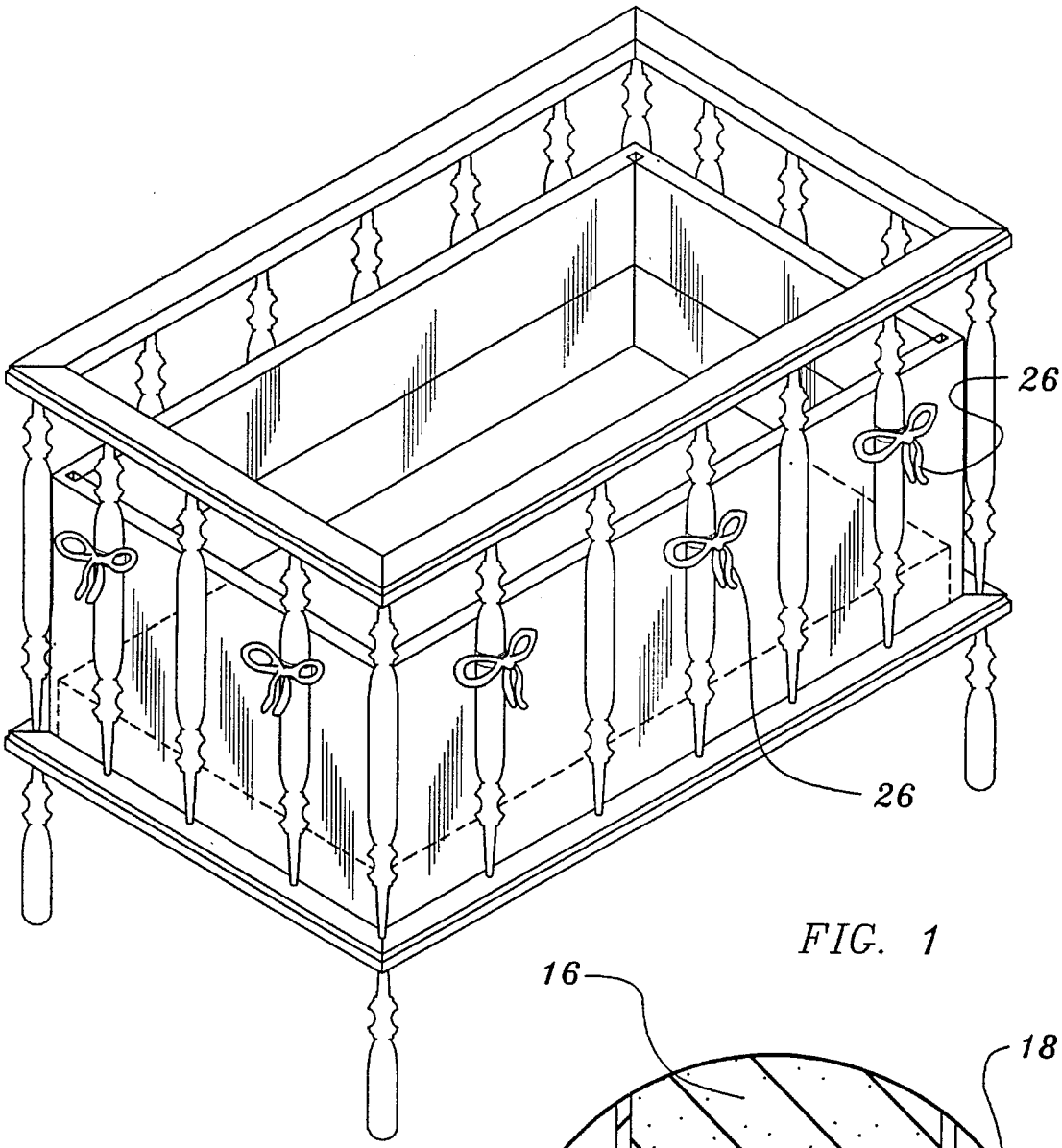
FIG. 1 is a perspective view of the preferred embodiment of the bedding system constructed in accordance with the principles of the present invention.
Figure 5:
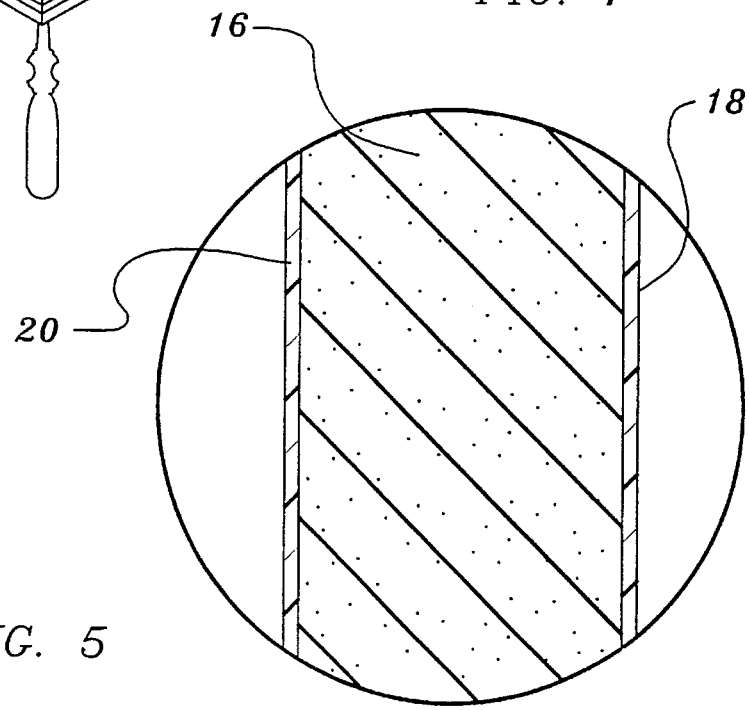
FIG. 5 is a cross section of the bumper pad.

With reference now to the drawings, and in particular to FIG. 1 thereof, the preferred embodiment of the new and improved bedding system embodying the principles and concepts of the present invention and generally designated by the reference numeral 10 will be described.

The present invention relates to a bedding system 10 for use in the interior of an infants crib. This invention enables the bedding to be changed quickly and easily. In its broadest context, the system employs a bumper pad 12 which is adapted to be secured within the crib structure and a sheet 14 which is adapted to be secured to the bumper pad 12. Thus, in use, the bumper pad 12 can remain fixed to the crib structure and the sheet 14 removed and replaced when new bedding is desired. Details as to the various components of the present invention, and the manner in which they interrelate, will be described in greater detail hereinafter.

In order to facilitate its placement within a standard crib, the bumper pad 12 is box shaped in the preferred embodiment. Furthermore, the bumper pad 12 is defined by first, second, third, and fourth sidewalls 16, a bottom surface and an exterior 18 and interior surface 20. Additionally, each of the sidewalls has an upper edge and a lower edge. In the preferred embodiment, the bumper pad 12 is constructed from cotton or a cotton polyester blend. The material should be thick enough to allow a certain degree of rigidity to the overall pad.

Velcro™ fasteners, or hook and pile fasteners, can be employed in securing the bumper pad 12 to the sheet 14. Hook and pile fasteners have two components. One of these components is rough (usually the hook portion) while the other smooth (usually the pile portion). A plurality of these "rough side" hook and pile fasteners 22 are secured to the interior surface 20 of the bumper pad 12 approximate the upper edge of the sidewalls 16. As previously indicated, these fasteners function in securing the bumper pad 12 to the sheet 14. Any number of fasteners can be employed for this interconnection.

Figure 2:
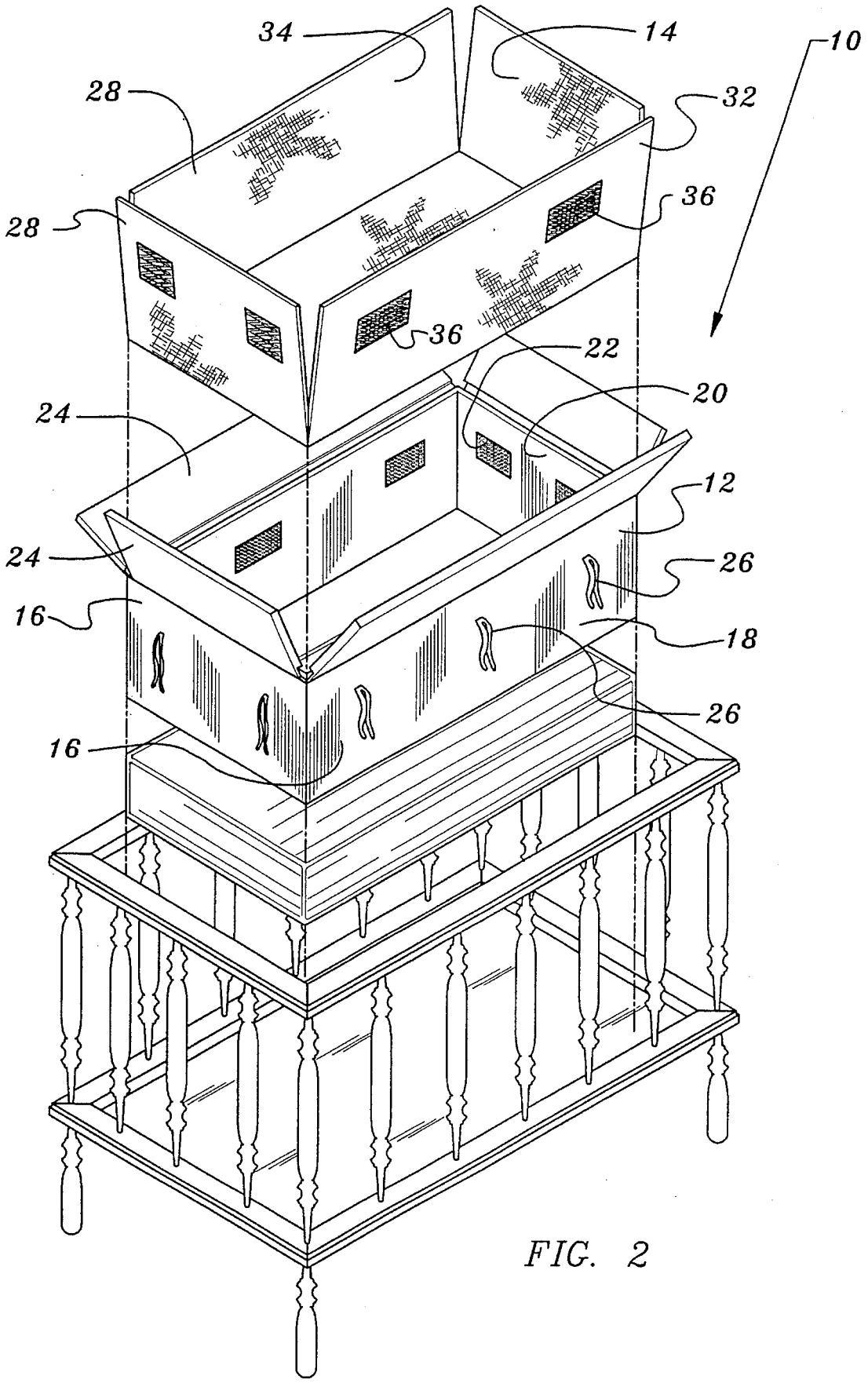
FIG. 2 is an exploded view of the bedding system of the present invention.
Figure 3:
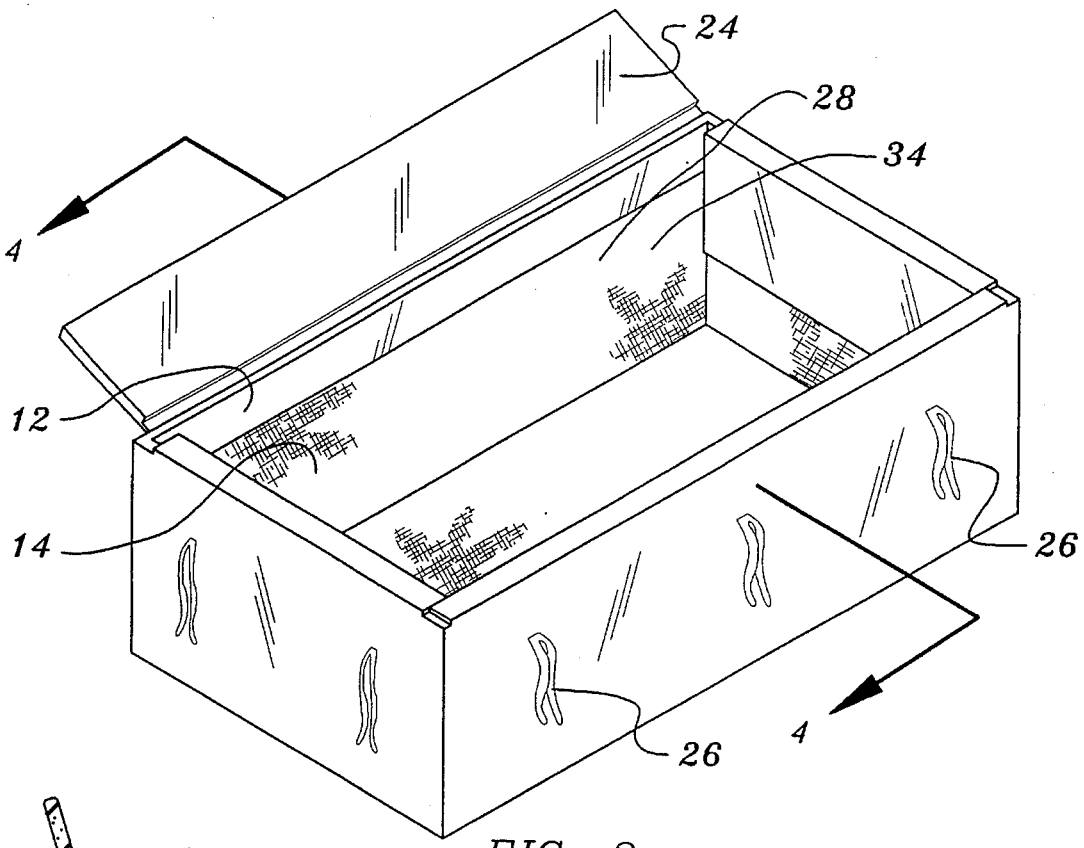
FIG. 3 is a view of the bumper pad with the sheet of the present invention.
Figure 4:
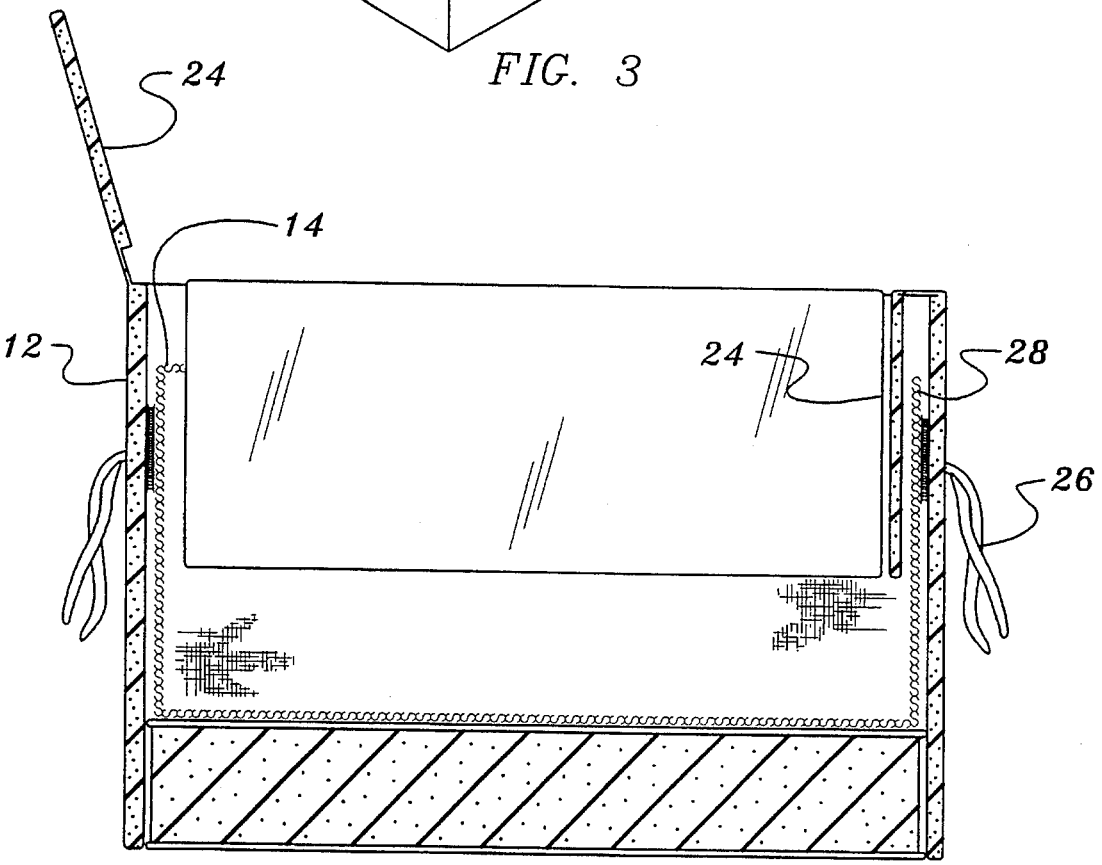
FIG. 4 is a cross section taken along line 4—4 of FIG. 3.

The bumper pad 12 further includes first, second, third and fourth flaps 24. As depicted in FIG. 2, the first flap is secured to the upper edge of the first sidewall, the second flap is secured to the upper edge of the second sidewall, the third flap is secured to the upper edge of the third sidewall, and the fourth flap is secured to the upper edge of the fourth sidewall. Each of these flaps 24 has a first orientation wherein the flap is positioned over the interior surface of its corresponding side wall, and a second orientation wherein the flap is positioned over the exterior surface of its corresponding side wall. As indicated previously, and as indicated in FIG. 2, the bumper pad 12 includes means to secure it to an existing crib. In the preferred embodiment, this takes the form of a plurality of tie fasteners 26 positioned upon the exterior surface 18 of the sidewalls 16 intermediate the upper and lower edges. These tie fasteners 26 are tied to the interior of an infants crib when the bumper pad 12 is to be secured.

As with the bumper pad, the sheet 14 is box shaped. Furthermore, the sheet 14 is defined by a first, second, third and a fourth side wall 28, a bottom surface, an exterior surface 32 and an interior surface 34. As indicated in FIG. 2, the sidewalls of the bumper pad can be unattached along their adjacent edges, yet attached to the bottom surface. This configuration enables slight adjustment of the peripheral dimensions of the sheet. However, in an alternative embodiment, the adjacent edges of the sidewalls are secured to one another. Additionally, each of these side walls has an upper edge and a lower edge. A plurality of "smooth side" hook and pile fasteners 36 are secured to the exterior surface 32 of the sheet 14 approximate the upper edge of the sidewalls. As indicated previously, these fasteners are for use in joining the sheet 14 to the bumper pad 12. The sheet 14 is specifically dimensioned to be received within the bumper pad 12. When joining the sheet 14 to the bumper pad 12, the sheet 14 is positioned such that the exterior surface 32 of the sheet 14 meets the interior surface 20 of the bumper pad 12. Furthermore, the rough side hook and pile fasteners 22 of the bumper pad 12 are placed into positive engagement with the smooth side hook and pile fasteners 36 of the sheet 14. Then, in order to ensure that the sheet 14 is positively secured, each of the flaps 24 of the bumper pad 12 is positioned in the first orientation. Thus, as described, the bumper pad 12 is secured to the existing crib by way of the ties 26. Also the sheet 14 is secured to the bumper pad 12 through the use of the hook and pile fasteners, as well as the flaps 24 of the bumper pad 12 being folded over the four walls of the sheet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bedding system for the interior of an infant's crib, the bedding system comprising in combination:

a box shaped bumper pad having a first, second, third, and a fourth sidewall, a bottom, the bumper pad being defined by an exterior surface and an interior surface, each of the sidewalls having an upper edge and a lower edge, a plurality of rough side hook and pile fasteners secured to the interior surface of the bumper pad approximate the upper edge of the sidewalls, a first, second, third and a fourth flap, the first flap being secured to the upper edge of the first sidewall, the second flap being secured to the upper edge of the second sidewall, the third flap being secured to the upper edge of the third sidewall, and the fourth flap being secured to the upper edge of the fourth sidewall, each of the flaps having a first orientation wherein the flap is positioned over the interior surface of its corresponding side wall and a second orientation wherein the flap is positioned over the exterior surface of its corresponding side wall, a plurality of tie fasteners positioned upon the exterior surface of the sidewalls intermediate the upper and lower edges, the tie fasteners tied to the interior of an infants crib;

a box shaped sheet having a first, second, third and a fourth side wall, and a bottom surface, each of the side walls having an upper edge and a lower edge, the sheet being defined by an exterior surface and an interior surface, a plurality of smooth side hook and pile fasteners secured to the exterior surface of the sheet approximate the upper edge of the sidewalls, the sheet dimensioned to be received within the bumper pad, the sheet positioned such that the exterior surface of the sheet meets the interior surface of the bumper pad and the rough side hook and pile fasteners of the bumper pad come into positive engagement with the smooth side hook and pile fasteners of the sheet, the sheet being positively secured by positioning each of the flaps of the bumper pad in the first orientation.

2. A bedding system for the interior of an infant's crib, the bedding system comprising in combination:

a bumper pad having a first, second, third, and a fourth sidewall, a bottom, the bumper pad being defined by an exterior surface and an interior surface, each of the sidewalls having an upper edge and a lower edge, a plurality of fasteners secured to the interior surface of the bumper pad approximate the upper edge of the sidewalls, a first, second, third and a fourth flap, the first flap being secured to the upper edge of the first sidewall, the second flap being secured to the upper edge of the second sidewall, the third flap being secured to the upper edge of the third sidewall, and the fourth flap being secured to the upper edge of the fourth sidewall, each of the flaps having a first orientation wherein the flap is positioned over the interior surface of its corresponding side wall and a second orientation wherein the flap is positioned over the exterior surface of its corresponding side wall;

a shaped sheet having a first, second, third and a fourth side wall, and a bottom surface, each of the side walls having an upper edge and a lower edge, the sheet being defined by an exterior surface and an interior surface, a plurality of fasteners secured to the exterior surface of the mattress pad approximate the upper edge of the sidewalls, the sheet dimensioned to be received within the bumper pad, the sheet positioned such that the exterior surface of the sheet meets the interior surface of the bumper pad and the fasteners of the bumper pad come into positive engagement with the fasteners of the sheet, the sheet being positively secured by positioning each of the flaps of the bumper pad in the first orientation.

3. The bedding system as described in claim 2 wherein:

the plurality of fasteners of the bumper pad are rough side hook and pile fasteners; and the plurality of fasteners of the sheet are smooth side hook and pile fasteners.

4. The bedding system as described in claim 2 further comprising:

a plurality of tie fasteners positioned upon the exterior surface of the sidewalls of the bumper pad intermediate the upper and lower edges, the tie fasteners tied to the interior of an infant's crib.

* * * * *